US010329080B1

(12) United States Patent
Weissbrod

(10) Patent No.: US 10,329,080 B1
(45) Date of Patent: Jun. 25, 2019

(54) WELDING CONSUMABLE PACKAGING

(71) Applicant: Lincoln Global, Inc., Santa Fe Springs, CA (US)

(72) Inventor: Paul A. Weissbrod, South Euclid, OH (US)

(73) Assignee: LINCOLN GLOBAL, INC., Santa Fe Springs, CA (US)

( * ) Notice: Subject to any disclaimer, the term of this patent is extended or adjusted under 35 U.S.C. 154(b) by 0 days.

(21) Appl. No.: 15/973,639

(22) Filed: May 8, 2018

(51) Int. Cl.
*B65D 81/05* (2006.01)
*B65D 85/04* (2006.01)

(52) U.S. Cl.
CPC ..... *B65D 85/04* (2013.01); *B65D 81/051* (2013.01); *B65D 81/057* (2013.01); *B65D 2581/053* (2013.01)

(58) Field of Classification Search
CPC .... B65D 85/04; B65D 81/051; B65D 81/053; B65D 81/054; B65D 81/057; B65D 81/05; B65D 81/056
USPC ..... 206/410, 408, 586, 524, 591, 396, 395, 206/389
See application file for complete search history.

(56) References Cited

U.S. PATENT DOCUMENTS 3,008,627 A * 11/1961 Antliff ..... B65D 5/4608 229/117.13
3,161,339 A 12/1964 Weller
3,890,762 A 6/1975 Ernst et al.
4,287,265 A * 9/1981 McKnight ..... B65D 81/056 206/586
4,724,960 A * 2/1988 Goodrum ..... B65D 85/66 206/397
4,851,286 A 7/1989 Maurice
4,899,888 A 2/1990 Shawler
5,692,618 A * 12/1997 Beak ..... B65D 5/5088 206/320
6,092,654 A * 7/2000 Webb ..... B65D 5/5045 206/319

(Continued)

FOREIGN PATENT DOCUMENTS

EP 0 536 023 B1 5/1995

OTHER PUBLICATIONS

Cold Chain Technologies; "STS Frozen Parcel Family"; http://www.coldchaintech.com/product-details/sts/; Accessed on Feb. 5, 2018; pp. 1-6.

(Continued)

*Primary Examiner* — Steven A. Reynolds
(74) *Attorney, Agent, or Firm* — Bard C. Spencer

(57) ABSTRACT

A container for packaging a welding wire on a spool includes a box with opposed first and second face panels that are separated by four vertical side walls. At least one aperture on the four vertical side walls is defined by a frangible connection so that the interior of the box is initially inaccessible. At least one corner blocking insert includes an outer profile that corresponds to the spool of welding wire located within said box. After said frangible connection of the aperture is breached, the corner blocking is inserted into the interior of the box via said aperture and engages at least one of an outer perimeter rim of said spool containing a coil of welding wire, or an outer perimeter of the coil of welding wire. In various examples, the corner blocking insert is an expanding foam package, or a folded cardboard insert.

20 Claims, 10 Drawing Sheets

(56) References Cited

U.S. PATENT DOCUMENTS

| | | | | |
|---|---|---|---|---|
| 6,116,423 | A * | 9/2000 | Troxtell, Jr. | B65D 5/248 206/523 |
| 7,588,148 | B2 * | 9/2009 | Yang | B65D 5/5069 206/523 |
| 8,240,469 | B2 * | 8/2012 | Goda | B65D 19/20 206/386 |
| 8,464,870 | B2 | 6/2013 | Weissbrod | |
| 8,485,362 | B2 * | 7/2013 | Chan | B65D 81/057 206/586 |
| 2005/0161366 | A1 * | 7/2005 | Kobashi | B65D 5/0227 206/586 |
| 2005/0241978 | A1 | 11/2005 | Plue et al. | |
| 2006/0070909 | A1 * | 4/2006 | Mahon | B29C 44/183 206/524 |
| 2016/0200497 | A1 * | 7/2016 | Weissbrod | B65D 85/04 206/408 |
| 2017/0320689 | A1 * | 11/2017 | Ellis | B65H 16/005 |

OTHER PUBLICATIONS

Storopack; "Pre-qualified thermal delivery systems for temperature-sensitive products"; http://www.storopack.us/en/about-storopack/news/news-details/article/vorqualifizierte-thermische-versandsysteme-fuer-temperatursensible-produkte.html; Dated Jan. 7, 2015; pp. 1-2.

Marathon Products, Inc.; "Dry Ice Insulated Shippers"; http://www.recording-thermometer.com/product-packaging-deep-chill-boxes.html; Accessed on Feb. 5, 2018; pp. 1-2.

Taracell; "Cold Chain Container / Pallet Shipper"; https://www.taracell.com/en/; Accessed on Feb. 5, 2018; pp. 1-6.

Insulated Products Corp.; "48-hour Thermal Protection for Wine Shipment to Maintain Below 30° C."; https://ipcpack.com/resources/48-hour-thermal-protection-for-wine/; Accessed on Feb. 5, 2018; pp. 1-7.

Wrap-N-Pack; "Foam Corners & Edge Guards"; https://www.wrapnpack.com/foam-corner-protectors-and-edge-guards; Accessed on Feb. 5, 2018; pp. 1-2.

Tuff Angle Edge Protectors; "Understand the Characteristics of Tuff Angle Edge Protectors"; http://www.edgeprotectors.us/patent.html; Accessed on Feb. 5, 2018; p. 1.

Sealed Air; "Instapak Simple"; SealedAir.com; Accessed on Feb. 5, 2018; pp. 1-2.

Sealed Air; "Instapak Quick"; https://www.uline.com/Product/Detail/S-6135B/Cushioning-Systems/Instapak-Quick-Bulk-Pack-Bags-80-22-x-27?pricode=WA9173&gadtype=pla&id=S%E2%80%A61/2Home; Accessed Mar. 15, 2018; pp. 1-2.

* cited by examiner

WELDING CONSUMABLE PACKAGING

CROSS-REFERENCE TO RELATED APPLICATIONS

Not applicable.

FIELD OF THE INVENTION

The present invention relates generally to packaging and methods for the shipping of wire, and more particularly to spools wound with welding wire electrodes.

BACKGROUND OF THE INVENTION

In recent times, a substantial industry has been developed around providing coils of electric welding wire in square cardboard boxes. This is because welding has become a dominant process in fabricating industrial and commercial products. Applications for welding are wide spread and used throughout the world. Examples include the construction of ships, buildings, vehicles and pipe lines. Welding is also used in repairing or modifying existing products. Among the various methods of joining metal components, arc welding is one well known and very common process.

Arc welding may employ consumable welding wire, which in some instances may be wound on a spool for ease of dispensing. For purposes of protection during storage and shipping, such spools may be placed in cardboard cartons. Conventional cardboard boxes have been modified by a variety of structural elements in an effort to solve the many and diverse problems experienced by use of these boxes. While such cartons have provided sufficient protection during bulk shipment of spooled electrodes to distributors, the market for direct-to-consumer shipping requires additional safeguards for spools. For example, where a single spool of wire is shipped in a single container, there is a tendency of the wire spool to deform when the carton is dropped or otherwise impacted due to the weight/inertia of the welding wire and the forces it imparts onto the spool when dropped. If the wire spool deforms, it may become unusable for a welding procedure (e.g., causes problems during wire feeding).

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a container for packaging a welding wire comprises a box comprising opposed first and second face panels that are separated by four vertical side walls and four vertically extending corners. Each corner defines a corner void within an interior of the box. At least one aperture is on the four vertical side walls, located adjacent to one of the four vertically extending corners and being defined by a frangible connection on one of the four vertical side walls so that the interior of the box is initially inaccessible. At least one corner blocking insert comprises an outer profile that corresponds to a spool containing a coil of welding wire located within said box. After said frangible connection of the at least one aperture is breached, the at least one corner blocking is inserted into the interior of the box via said at least one aperture at one of the four vertical side walls. The at least one corner blocking insert engages at least one of an outer perimeter rim of said spool containing a coil of welding wire, or an outer perimeter of the coil of welding wire, located within said box. The corner blocking insert that is inserted into the interior of the box through the at least one aperture is arranged to abut against an interior surface of two adjacent vertical side walls located at said one vertically extending corner.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
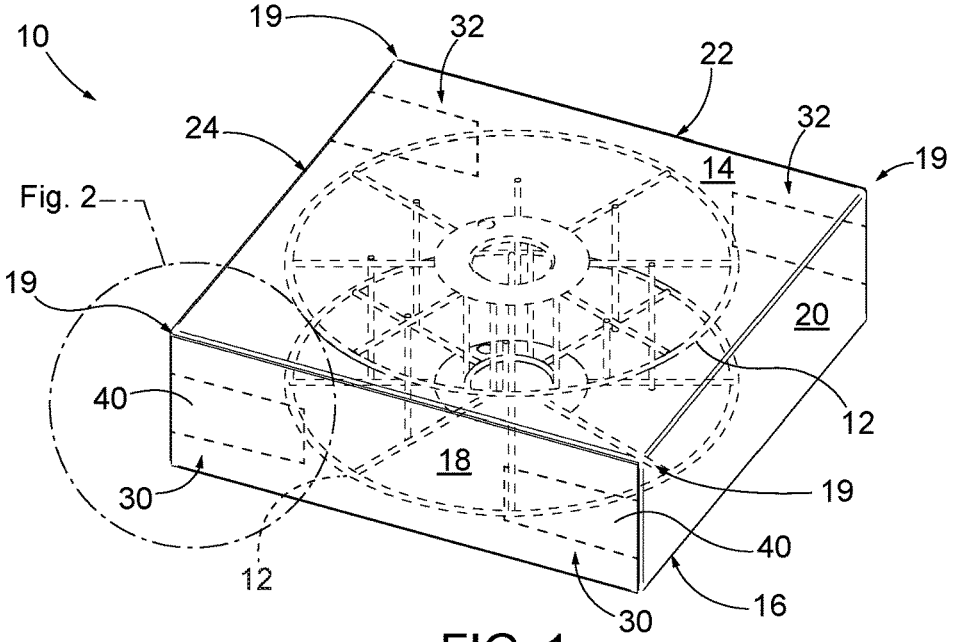
FIG. 1 illustrates a perspective view of one example container for a welding wire.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

It is common for manufacturers to provide coils of consumable welding wire electrodes in square cardboard boxes. However, round wire spools that are packaged in a square carton provide little protection to the edges and faces of the spool during the shipping process. Typical handling by common shipping carriers (i.e., UPS/FedEx) in the package shipping environments (as represented by ISTA-3A testing protocols) can damage the spool and thereby render the spool unable to dispense the welding wire after shipment. For example, the carton wall provides little protection of the spool faces in flat drops, and the round spool face edge has limited contact with the straight carton edge allowing it to easily lance through the carton wall on edge drops. Further, the empty corners of the carton provide only token resistance to crushing in corner drops. Conventionally, the prior art required the spool to be removed from its original labelled carton packaging to be properly packaged for the tougher common shipping carrier environment. Additionally, the prior art required a pre-glued assembly of the overpack components.

In short summary, the structure and method described in the instant application allows the spool to remain in its original labelled carton, but provides access to the corner voids of the carton for the insertion of void-filling cushion components. The inserted elements provide structural strength to the empty corners of the carton in corner drops.

The structure and method used to accomplish the foregoing can have various embodiments. In one example, a spool carton can have nicked, die-cut or score-line features (i.e., a perforation or kiss-cut) that can later be punched inward to create openings near the corners of the carton for insertion of support components that upgrade the structural strength of the package for shipping via common shipping carriers. The result is the formation of an integrated cradle that provides location and cushioning to the spool without having to remove the spool from its original carton packaging, as well as adding structural strength to the previously-empty corners of the carton. After the void filling elements are inserted, a foam cradle and a corrugate over-pack may be used to complete the package. The package may further include a facer plate on each flat face of the original carton to keep the flange faces supported flat in corner drops.

Turning to the shown example of FIG. 1, an example container 10 for packaging a welding wire is illustrated schematically. Typically, the welding wire is wound in a coil about a round spool 12 (wire not shown on spool for clarity), which is ultimately packaged within the container 10. As shown, the container 10 is in the form of a box comprising opposed first and second face panels 14, 16 that are separated by four vertical side walls 18, 20, 22, 24 and four vertically extending corners 19, each defining an apex 21. Preferably, the box is has a square geometry in order to accommodate the round wire spool, although different geometries are contemplated. Preferably, the first and second face panels 14, 16 are connected to the four vertical side walls 18, 20, 22, 24 so that the spool 12 is entirely enclosed within the container 10. As so far described, the container 10 is standard and is constructed as an optimum type of square cardboard container for shipping and unwinding welding wire.

The container 10 further comprises a plurality of apertures 30, 32 that are preferably located on the on at least two of the vertical side walls 18, 20, 22, 24. More preferably, at least one aperture 30, 32 is located adjacent each of the four vertically extending corners 19. However, it is contemplated that only two apertures could be used to provide access to all four corner areas within the container 10. For the sake of clarity, only the apertures 30 on the first side wall 18 will be described in detail, with the understanding that the apertures 32 on some or all of the other vertical side walls 20, 22, 24 can be similar, or even different. Preferably, the apertures 30, 32 are disposed on opposite sides of the container 10 to thereby provide access to all four vertically extending corners 19. For example, when apertures 30 are located on the first side wall 18, then apertures 32 could be provided on the opposite vertical side wall 22. Moreover, although the apertures 30 on the first side wall 18 are shown as identical, it is understood that multiple different apertures can be used. Each aperture 30 is adjacent to, and optionally bounded on, one or more sides 34, 36 by adjacent side walls of the box. In FIG. 1, for example, the aperture 30 is adjacent to first and second face panels 14, 16, and spaced a distance therefrom. Depending upon the location and size of the aperture 30, it is further contemplated that one or more sides 34, 36 can be bounded by the first and second face panels 14, 16.

Although ultimately the apertures 30 will provide access into an interior of the box, each aperture is initially closed-off and defined by a frangible connection on one of the associated vertical side wall 18, 20, 22, 24 so that an interior of the box is initially inaccessible. The frangible connection of each aperture 30 comprises at least one non-frangible hinge side 38 that is secured to one of the face panels or vertical side walls to form a pivotable flap 40 once the frangible connection is breached. In the shown example, the two sides 34, 36 are frangible, while the hinge side 38 adjacent the vertically extending corner 19 is non-frangible, to later provide the pivotable flap(s).

Figure 2:
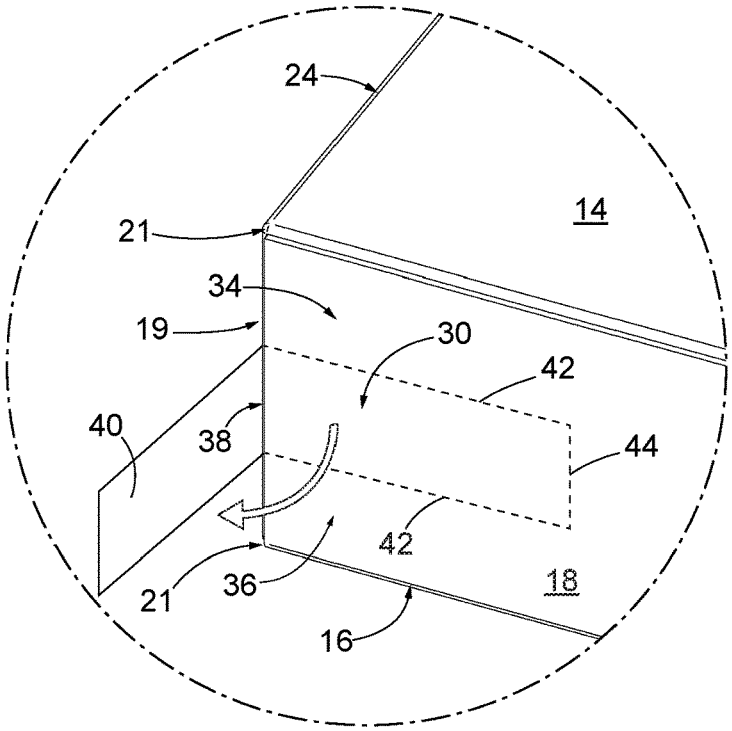
FIG. 2 illustrates a detailed view of FIG. 1.

As shown in FIG. 2, the frangible connection of each aperture 30 will be described in detail, with reference to the example shown on vertical side wall 18. It is understood that the other apertures 30 on other vertical side walls can have similar structure. The aperture 30 comprises at least one side 42 with an at least partial die-cut or score-line (i.e., a through-cut, a kiss-cut, or a perforated cut). The die-cut or score-line extends along the least one side 42 and either partially or completely through the associated vertical side wall 18. The die-cut or score-line may extend only partially through the vertical side wall 18 so that the container 10 initially retains some structural rigidity about the corners until the frangible connection is breached. Further, whether extending partially or completely through the face panel, the die-cut or score-line may be continuous or dis-continuous. The frangible connection provided by the at least one side 42 allows the flap 40 to be pulled outwards or punched inward to allow the aperture 30, when desired, to create openings at the corners of the container 10 for insertion of corner reinforcing elements.

The at least one side 42 may extend between and connect other sides 34, 36 of the aperture 30. In one example, some or all of these apertures can have a generally rectangular geometry, as shown, but other geometries are contemplated (square, triangular, quadrilateral, polygonal, random, etc.). Additionally, it is understood that the at least one side 42 may be straight or curved. Where the aperture 30 has a generally rectangular geometry, the at least one side 42 can comprise two major sides 42 that are connected by a minor side 44. In the orientation shown in FIG. 1, the major sides 42 can be relatively longer and the minor side 44 can be relatively shorter. Preferably, the frangible connection of the aperture 30 is a die-cut or score-line can be a through-cut, a kiss-cut, or a perforated cut that extends along substantially the entire length of both majors sides 42 and minor side 44. The frangible connection may be continuous or dis-continuous along the major and minor sides 42, 44. Furthermore, the major and minor sides 42, 44 may have multiple features, such as various curved or straight sections that ultimately connect to the sides 34, 36. In one example, the major and minor sides 42, 44 may be sized so that the resulting apertures 30 provide suitable access to an internal corner void area 49 within the container 10 that is approximate to the outer diameter of the spool 12.

Optionally, the frangible connection of each aperture 30 may also comprise an at least partial secondary die-cut or score-line (not shown) to thereby separate the pivotable flap 40 into a pair of independent pivotable flaps. For example, such a secondary die-cut or score-line could horizontally bifurcate the aperture 30 into two separate and independent flaps that could be vertically separable. As before, the secondary die-cut or score-line can be a through-cut, a kiss-cut, or a perforated cut, and may be continuous or dis-continuous.

After the frangible connection(s) of an aperture 30 is breached along major and minor sides 42, 44, the single or multiple flap(s) pivot about the hinge side 38, which acts as a living hinge. The flap(s) 40 are pulled outwards so that the aperture 30 exposes the interior of the box, and in particular, access to the associated corner void of the container 10. Optionally, the flap(s) can be pressed inwardly to be received within the interior of the box.

Figure 3:
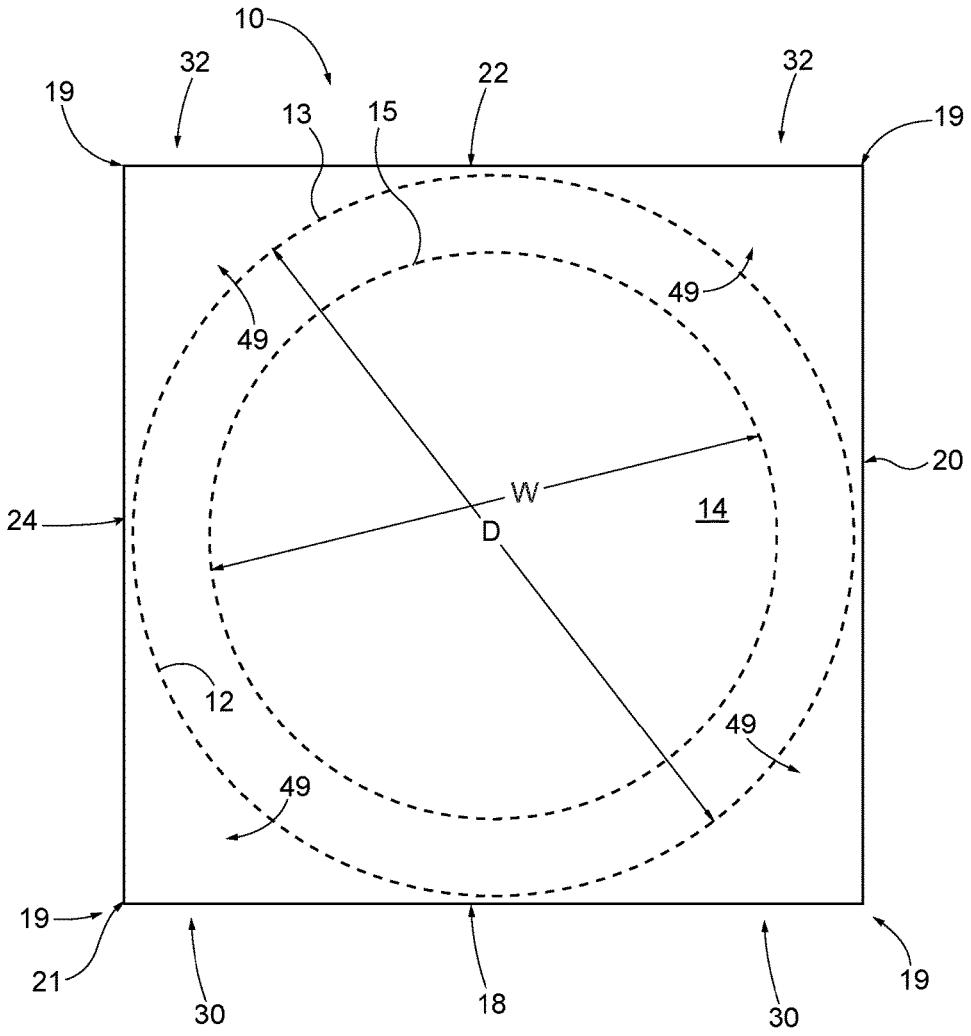
FIG. 3 illustrates a top view of the container of FIG. 1.

Turning briefly to FIG. 3, a top view of the container 10 is shown with an outer profile of the spool 12 shown in dashed lines, with the distance D being approximate to the outer diameter of the spool 12. As can be seen, the diameter of the spool 12 is similar to the size of the container 10 across the four side walls 18, 20, 22, 24. However, as can also be seen, the container 10 includes four corner voids 49 (i.e., empty corners) of the carton at which the spool 12 is generally not supported and which provide only token resistance to crushing in corner drops. The corner voids 49 extend vertically within the container interior along the full extent of each of the four extending corners 19, from apex 21 (at panel 14) to apex 21 (at panel 16). Additionally, each corner voids 49 extends laterally along corresponding ones of the side walls 18, 20, 22, 24 up to the outer diameter of the spool 12.

Turning now to FIGS. 4-8 several embodiments of void-filling cushion components that act as corner reinforcing elements will be discussed, referred to herein as a corner blocking inserts 50. Each corner blocking insert 50 will be inserted into the container 10 via one of the apertures 30, 32 and will be positioned within a corner void 49 to provide structural strength to at least one empty corner of the container 10. The corner blocking insert(s) 50 are used to rigidify the corners of the container 10, and otherwise maintain the squareness of the box. The at least one corner blocking insert 50 penetrates into the interior of the box via the aperture 30, 32 after said frangible connection of said aperture is breached. Thus, during assembly, the frangible connection is first breached and then the corner blocking insert 50 is inserted into the container 10. Still, it is optionally contemplated that the act of forcibly inserting the corner blocking insert 50 into the box can be the mechanism that causes the breach of the frangible connection. In preparation for shipping a coil of welding wire, at least one corner blocking insert 50 thereby engages an outer perimeter rim of said spool 12 containing a coil of welding wire located within said container 10. Preferably, a total of four corner blocking inserts 50 are used, with one each located at and filling each of the four corner voids 49 within container 10. Still, it is understood that the instant application can be used with various numbers of corner blocking inserts 50, such as 1, 2, 4, 8, or other numbers. If only a single corner blocking insert 50 is used, it is contemplated that it could engage multiple outer perimeter rims (i.e., each rim of the spool adjacent to the first and second face panels 14, 16) on both sides of the spool containing a coil of welding wire located within said box. If multiple corner blocking inserts 50 are used, then preferably all of the corner blocking inserts 50 are substantially identical, so as to be cost effective to manufacture. Use of the corner blocking inserts 50 will serve to reduce the impact on the side walls 18-24 of the box from the spool during transportation, and will further distribute impact energy that results from dropping the packaged spool.

Each corner blocking insert 50 is configured to contact both the interior walls of the container 10 and the outer perimeter rim 13 of the spool 12 to act as a buffer therebetween. The corner blocking insert 50 includes a profile that corresponds to, and is preferably complementary to, an outer perimeter rim 13 of a spool 12 containing a coil of welding wire located within the box. As also shown in FIG. 3, the coil of welding wire on each spool 12 can have an outer perimeter 15 defining an outer diameter W slightly less than that of the spool 12. Preferably, the corner blocking insert 50 includes a profile that also corresponds to, and is preferably complementary to, the outer perimeter 15 of the coil of welding wire. Having the corner blocking insert 50 directly engage the outer perimeter 15 of the welding wire can help prevent the wire and core of the spool 12 from moving relative to the outer perimeter rim 13 of the spool, and help prevent the spool from deforming should the spool of wire be dropped. For example, the wire rim of a wire cage style spool as shown in dashed lines in FIG. 1 can deform when dropped, due to the inertia of the welding wire at the core of the spool. Having the corner blocking insert 50 directly engage the outer perimeter 15 of the welding wire can help prevent deformation of the wire rim of the spool. In this manner, each corner blocking insert 50 acts as a buffer directly between the interior walls of the container 10 and the welding wire on each spool 12 at each corner void 49.

Figure 4:
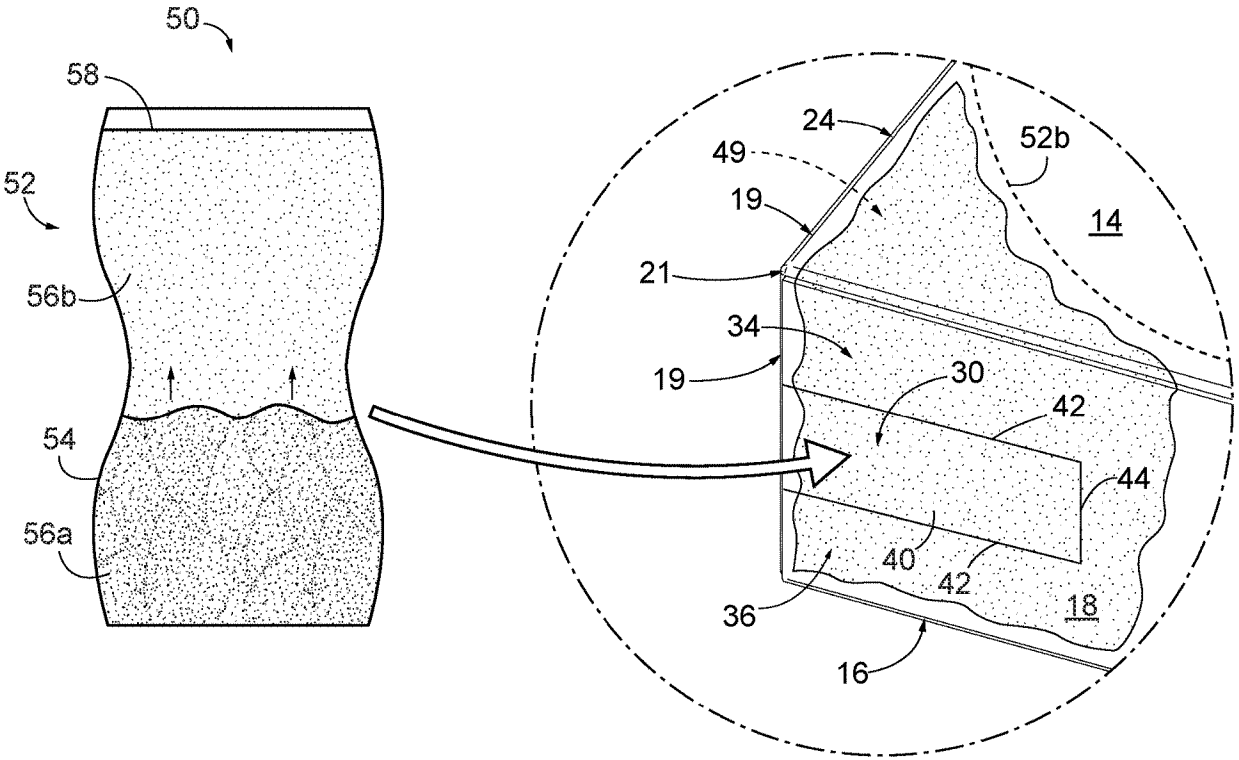
FIG. 4 illustrates a schematic view of a first embodiment of a corner blocking insert within the container.
Figure 5:
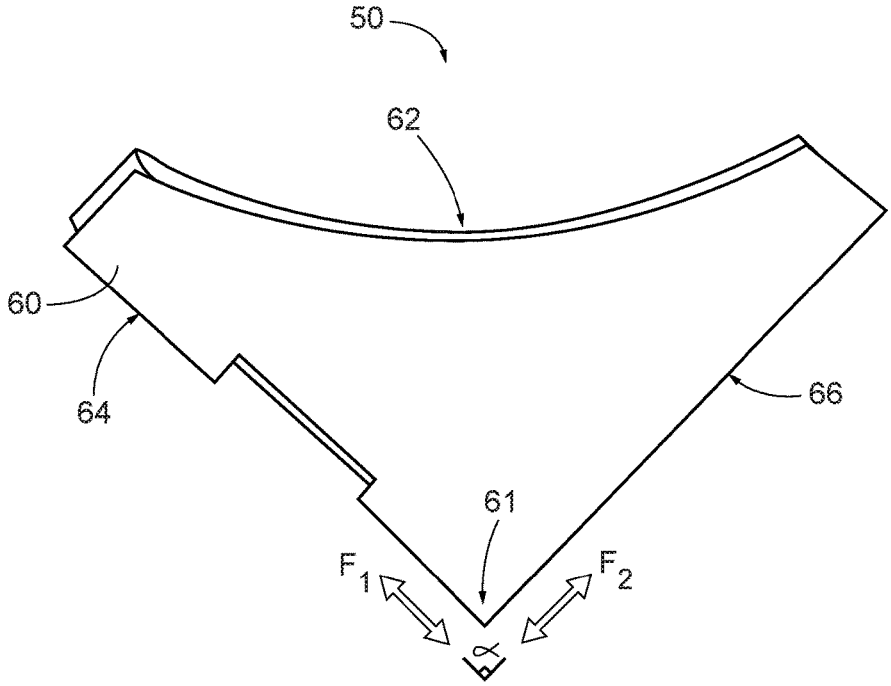
FIG. 5 illustrates a top view of a second embodiment of a corner blocking insert.

Turning now to FIG. 4, in a first embodiment, the corner blocking insert 50 can comprise an expanding foam package 52 that is malleable when inserted into the cardboard box, and cures quickly to a rigid foam thereafter. One advantage is that the foam expands to fill substantially all available space in the corner void 49 of the container 10, and provides a "custom form fit" against the spool and container interior. Another advantage is that the foam, once cured, provides a monolithic body that generally prevents both movement of the spool within its box and possible lancing of the box by the rim of the spool, and movement of the wire and core of the spool relative to the spool rim, which tends to deform the spool.

Preferably, the foam corner blocking insert 50 is provided as a self-contained package whereby the expanded foam is retained within a thin bag or other intermediary structure that acts as a barrier to enable the expanding foam to conform to the interior of the box and exterior of the spool, without the foam material itself seeping into and between the coil of welding wire. In this way, the many benefits of the foam are utilized while reducing clean-up upon opening the container 10. Various types of foam packages may be utilized. In some examples, the foam package 52 may be a foam-in-bag packaging system sold under the trade name Instapak® by the company Sealed Air®, although other similar types of expanding foam may be used from other manufacturers. The foam packages 52 can be filled with the expanding foam material on-site immediately prior to use, or alternatively, the foam packages 52 can be self-contained packages that are pre-filled with expanding foam and which have chemical activation system required before use, such as a manual mixing of chemicals.

In either case, the foam package 52 generally includes a malleable bag 54 formed of plastic or other similar thin body material. Optionally, the bag 54 also comprises a stretchable material. The bag 54 initially contains un-cured foam material 56*a* and optionally an activator chemical (not shown). Mixing of the un-cured foam material 56*a* and activator causes a chemical reaction to occur whereby the foam begins to expand in size and volume, and ultimately cure into a substantially rigid foam 56*b*. If the foam packages 52 are of the type that is filled with the expanding foam material 56*a* on-site immediately prior to use, then the activator chemical may similarly be added and/or mixed at that time. In this case, the bag 54 can include an opening 58, such as at one end of the bag 54 or other suitable location, through which the foam material 56*a* and/or activator chemical can be received. Thereafter, the opening 58 can be sealed in various manners, such as by a heat seal, welding, adhesives, mechanical valve, clamp, or other fastener, etc.

When the foam package 52 is ready to use and the un-cured foam material 56*a* has been activated (i.e., begins the chemical reaction to expand and cure), the malleable foam package 52 is inserted into the container 10 at a corner void 49. First, the frangible connection is breached along the sides 42, 44 of the pivotable flap 40, and the flap 40 is then pulled outwards about the hinge side 38 to expose the aperture 30 (optionally, the flap 40 could be pushed inside the container 10). Next, the activated foam package 52 is inserted into the interior of the container 10 and is located at the corner void 49. The foam package 52 may be located in abutment with the outer perimeter rim 13 of the spool 12 and/or outer perimeter 15 of the coil of welding wire, or in abutment with interior walls of the container 10 along the vertically extending corner 19, or at a location intermediate these items. After the foam package 52 is inserted, the flap 40 may be pivoted back to the closed position thereby closing off the aperture 30. Preferably, the flap 40 is then secured in place by application of an adhesive tape or the like applied to the exterior of the container 10 along the respective side wall 18, 20, 22, 24.

At this time, the foam material 56*a* within the activated foam package 52 will be expanding in size and volume to fill the corner void 49, and will begin to cure into the rigid foam 56*b*. The foam package 52 should be selected and sized so that once the foam material 56*a* completely cures, the expanded, rigid foam 56*b* will substantially completely fill the corner void 49 and be in contact with the interior walls of the container 10 (e.g., as shown in FIG. 4, side walls 18 and 24, and panels 14 and 16) as well as the outer perimeter rims 13, 15 of the spool 12 and welding wire coil, respectively, to act as a buffer therebetween. The cured foam package 52B is shown schematically within the container 10 in FIG. 4. It is contemplated that during the curing process, the initially uncured foam is highly conformable to its environment and to the shapes it contacts, so that an outer profile of the finally cured foam corresponds to the spool containing a coil of welding wire located within said box. In this way, each foam package 52 will be custom-fit to the unique and specific geometry of each corner void 19 of each container 10. This can be especially advantageous since the amount of welding wire contained on each spool 12 (and its ultimate diameter) may vary from item to item. Preferably, a total of four corner blocking inserts 50 (i.e., four foam package 52) is used at in the container 10 (i.e., one per each of the four corner voids 49). However, it is contemplated that less than four, such as two or even one, foam package 52 can be used. For example, two elongated foam packages 52 could be used that are of sufficient size to extend between and fill two corner voids (for example, one elongated foam package could extend along the entire length of side wall 24, and fill the corner voids 49 at the intersection of side walls 18, 24, and also at the intersection of side walls 22, 24). The use of such elongated foam packages 52 could be advantageous to reduce the number of flaps and apertures on the container 10, as well as speed up the product packaging time. After the container 10 is delivered to the end customer and the spool 12 is removed from the container 10, the corner blocking insert(s) 50 are discarded or recycled.

Figure 7C:
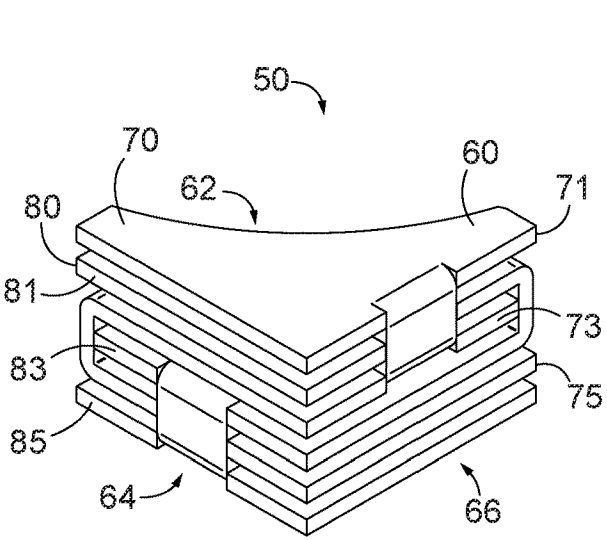
FIGS. 7A-7C illustrate various computer-generated perspective views of the corner blocking insert of FIG. 6.
Figure 7B:
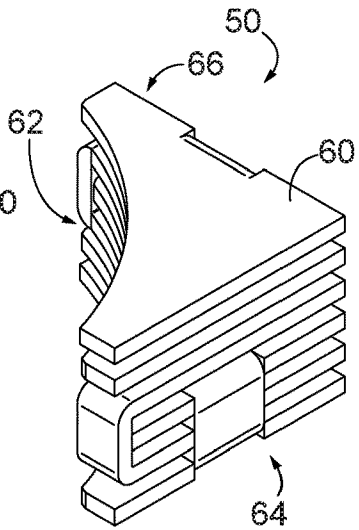
Figure 7A:
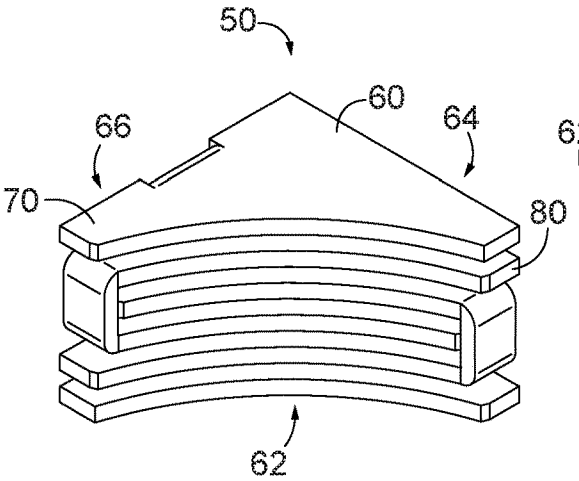
Figure 8:
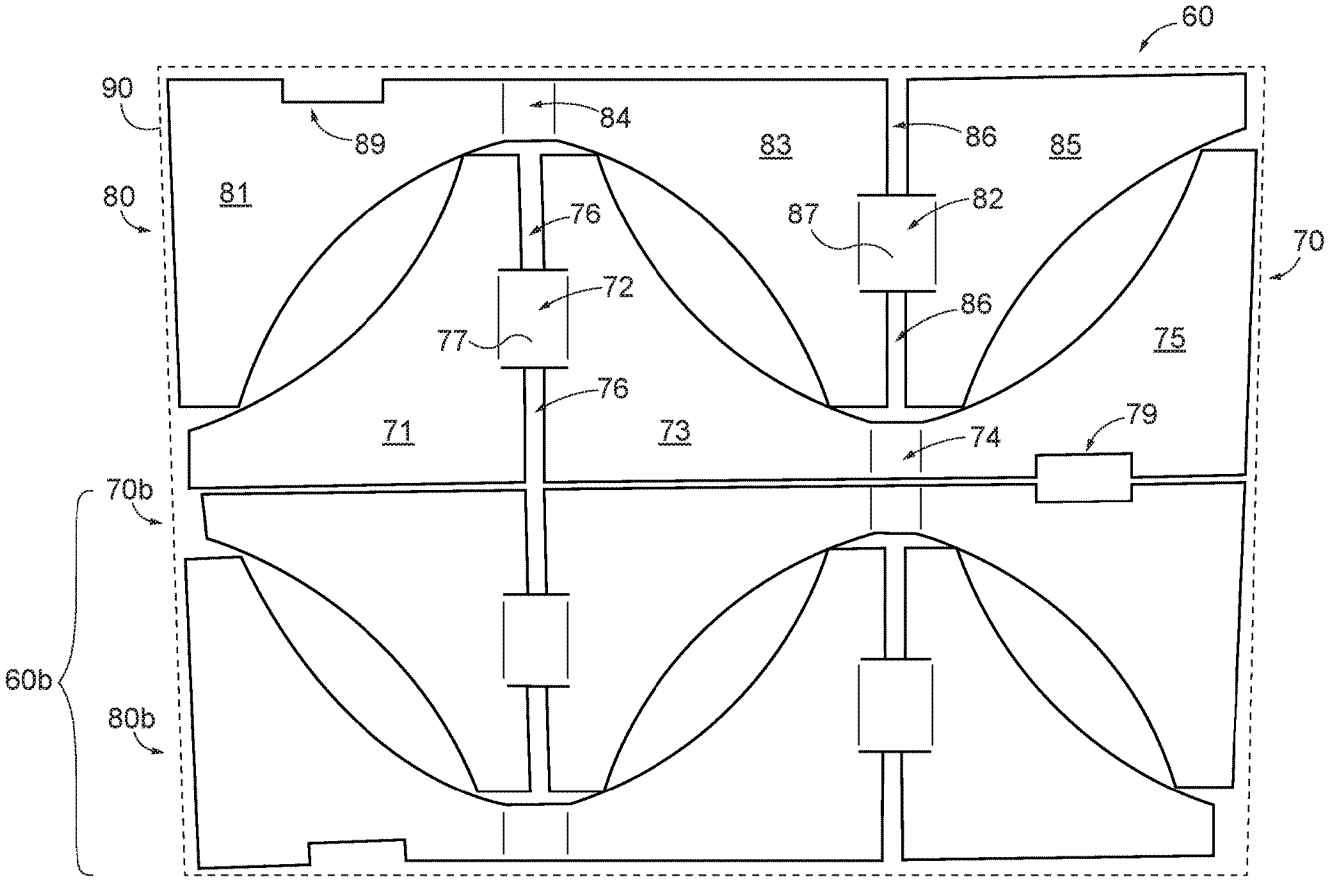
FIG. 8 illustrates a top view of an unassembled corner blocking insert of FIG. 5.
Figure 9:
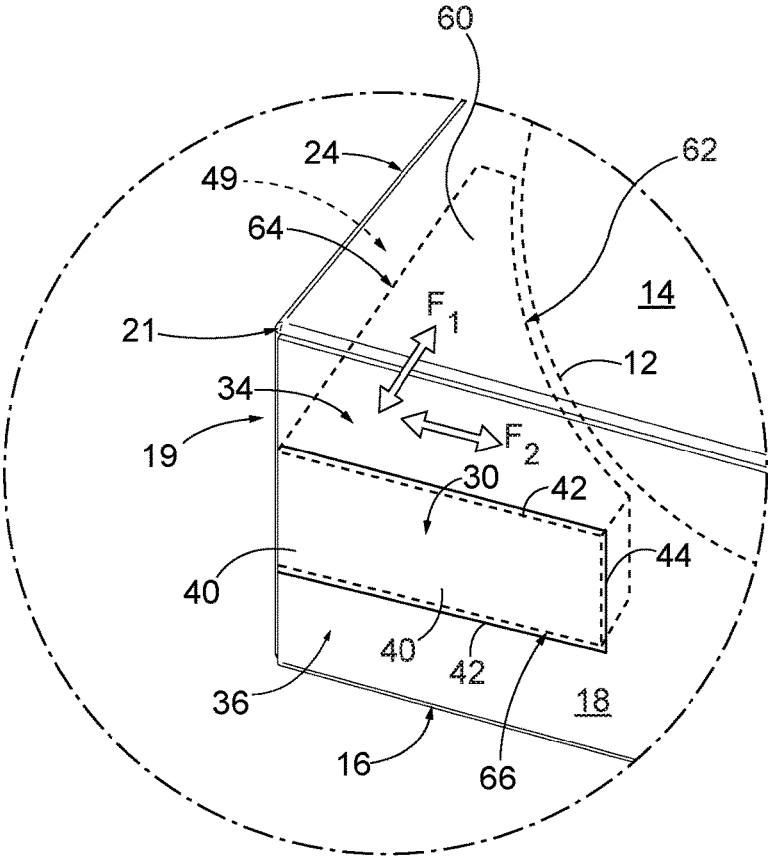
FIG. 9 illustrates a schematic view of the corner blocking insert of FIG. 5 within the container.

Turning now to FIGS. 5-9, in a second embodiment, the corner blocking insert 50 can comprise a folded cardboard insert 60. Preferably, the folded cardboard insert 60 is a combination of two folded inserts so that the cardboard flutes are oriented in two perpendicular planes (i.e., 90 degrees to each other). This provides structural rigidity along two axes. With reference to the top view of FIG. 5, one edge 62 of the folded cardboard insert 60 has a curved, concave profile that mates against the wire spool 12, against either or both of the outer perimeter rim 13 of the spool 12 and/or the outer perimeter 15 of the coil of welding wire. Two other edges 64, 66 of the folded cardboard insert 60 are generally straight and preferably perpendicular, and are configured to abut two adjacent interior vertical side walls 18, 20, 22, 24 of the container 10 when the folded cardboard insert 60 is installed in a corner voids 49 of the container 10. Additionally, the corner intersection 61 of the folded cardboard insert 60 is positioned at the vertically extending corner 19 of the container 10. For example, as shown in FIG. 9, the installed folded cardboard insert 60 can abut against the interior surface of side walls 18 and 24. In this way, any force applied to the spool 12, such as by a corner drop of the container 10, are absorbed and supported by the folded cardboard insert 60 against the vertical side walls 18, 20, 22, 24.

In the shown example, the curved edge 62 includes a curved or angled profile that has a radius substantially the same as that of the outer perimeter rim 13 of the spool 12. In another example, the curved edge 62 may include a curved or angled profile that has radius substantially the same as the outer perimeter 15 of the coil of welding wire. In either case, the curved edge 62 preferably has a profile that also corresponds to, and is preferably complementary to, the outer perimeter rim 13 of the spool 12 or the exterior surface at the outer perimeter 15 of the coil of welding wire. Additionally, the curved or angled profile of the curved edge 62 can have a radius slightly less than that of the outer perimeter rim 13 of the spool 12 or the exterior surface at the outer perimeter 15 of the coil of welding wire so as to apply a resilient force upon the spool 12 and/or welding wire. Such a force, when applied by one or more corner blocking inserts 50, can help to maintain the spool 12 in the center of the container 10. Still, other profiles are contemplated.

Preferably, a total of four corner blocking inserts 50 (i.e., four folded cardboard inserts 60) are used at in the container 10 (i.e., one per each of the four corner voids 49). However, it is contemplated that less than four, such as two or even one, folded cardboard insert 60 can be used. Additionally, it is contemplated that the folded cardboard insert 60 can have various horizontal lengths and vertical thicknesses. In one example, as shown in FIG. 9, the length and width of the folded cardboard insert 60 is similar to, or preferably slightly smaller than, the size of the flap 40 and associated aperture 30. That is, the folded cardboard insert 60 is generally similar in size to the major and minor sides 42, 44 so that the folded cardboard insert 60 can be readily inserted into the container 10 via the aperture 30. However, it is contemplated that the folded cardboard insert 60 could have a size and geometry that is relatively larger than either or both of the flap 40 and associated aperture 30; in this case, the folded cardboard insert 60 could be inserted by re-orienting it during insertion and/or temporary compression during insertion, etc. For example, the insert 60 can be compressed down vertically during insertion to fit through the aperture 30, and then expand (e.g., like an accordion) upward once inserted into the box.

Where the folded cardboard insert 60 has a vertical height similar to that of the aperture 30, which is generally less than the height of the vertical side walls 18, 20, 22, 24, the folded cardboard insert 60 is also less than the height of the vertical side walls 18, 20, 22, 24. That is, absent the ability to expand as described above, it would not extend vertically within the container interior along the full extent of each of the four extending corners 19, from apex 21 (at panel 14) to apex 21 (at panel 16), but instead would only float generally at a location therebetween. For example, the vertical position of the folded cardboard insert 60 can be generally in the middle of the vertical side walls 18, 20, 22, 24, as shown in FIG. 9. The folded cardboard insert 60 can be sized to have a compressed fitting against the exterior of the spool 12 to thereby maintain its location within the corner void 49. In other optional embodiments, any of the edges 62, 64, 66 of the folded cardboard insert 60 can include a pressure sensitive adhesive or the like that adhere to the interior of the container and/or exterior of the spool to help maintain the position. In yet another optional embodiment, the folded cardboard insert 60 may fall by gravity to the bottom of the corner void 49 and rest against one of the face panels 14, 16. In a further embodiment, the insert 60 can expand vertically once inserted into the corner void 49 to generally fill the void and prevent radial movement of the spool and its wire core.

Figure 6:
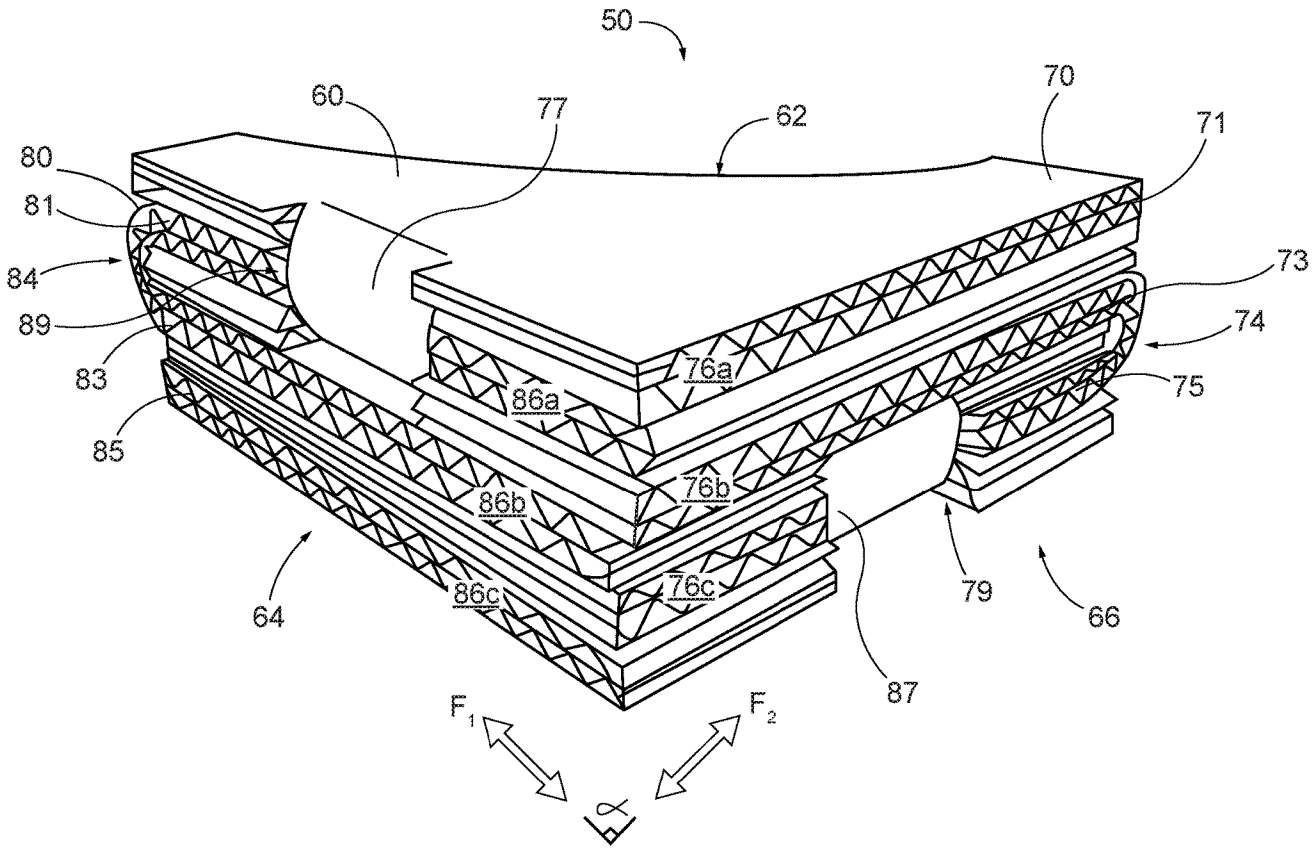
FIG. 6 illustrates a perspective view of an assembled corner blocking insert of FIG. 5.

Turning now to FIGS. 6 and 7A-7C, a side profile of the side edges 64, 66 is shown in greater detail. As noted above, the corner blocking insert 50 can comprise a folded cardboard insert 60. Corrugated cardboard possesses increased strength and dimensional stability compared to un-corrugated (i.e. flat) webs of the same material. In particular, corrugated cardboard is strongest in the longitudinal direction of the corrugated flutes. Corrugated paperboard or cardboard is widely used in storage and shipping boxes and other packaging materials to impart strength. A typical corrugated cardboard structure known as single-wall includes a corrugated paperboard web comprising flutes sandwiched between opposing un-corrugated paperboard webs referred to as liners (i.e., two liners and one corrugated web). The opposing liners are adhered to opposite surfaces of the corrugated web to produce a composite corrugated structure, typically by gluing each liner to the adjacent flute crests of the corrugated web. This structure is manufactured initially in planar composite boards, which can then be cut, folded, glued or otherwise formed into a desired configuration to produce a box or other form for packaging. Additionally, a double-wall corrugated cardboard construction can be used, as shown in FIG. 6, which includes two corrugated webs connected together by three liners (two exterior liners, and one middle liner). Other configurations of corrugated cardboard (e.g., triple-wall, etc.) could also be used.

As noted above, folded cardboard insert 60 is a combination of two folded inserts so that the cardboard flutes of the corrugated web are oriented preferably in two perpendicular planes (i.e., 90 degrees to each other) that correspond to the two perpendicular vertical side walls 18, 20, 22, 24 of the container 10. That is, the longitudinal direction of the corrugated flutes of the two folded inserts are oriented to be perpendicular to each other. In this way, the folded cardboard insert 60 has improved strength along both directions associated with the two perpendicular vertical side walls 18, 20, 22, 24 that the folded cardboard insert 60 abuts within the container 10. However, it is contemplated that the cardboard flutes of the folded cardboard insert 60 could be oriented at different other angles relative to each other as may be desired.

As shown in FIG. 6, the folded cardboard insert 60 is a combination of two folded inserts, referred to as a first insert 70 and a second insert 80. Although this embodiment will be described as being formed of two folded inserts, it is contemplated that three, four, or more inserts can be combined together as desired. In the example shown, the first insert 70 comprises three layers 71, 73, 75 that are interwoven with three corresponding layers 81, 83, 85 of the second insert 80. That is, as shown, the three layers 71, 73, 75 are interleaved in an alternating pattern with the three corresponding layers 81, 83, 85. The respective top and bottom faces of the layers 71, 73, 75 abut and are pressed against the top and bottom faces of the three corresponding layers 81, 83, 85.

The first and second inserts 70, 80 are arranged relative to each other so that the longitudinal direction F1 of the first corrugated flutes 76*a*-76*c* of the first insert 70 are arranged at an angle α, preferably perpendicular (i.e., 90 degrees), to the longitudinal direction F2 of the second corrugated flutes 86*a*-86*c* of the second insert 80. Due to the interleaved arrangement, it is understood that the first corrugated flutes 76*a*, 76*b*, 76*c* of the layers 71, 73, 75, respectively, are all arranged are all oriented along the longitudinal direction F1, and similarly the second corrugated flutes 86*a*, 86*b*, 86*c* of the layers 81, 83, 85, respectively, are all arranged are all oriented along the longitudinal direction F2.

FIGS. 7A-7C illustrate various computer-generated perspective views of the corner blocking insert of FIG. 6. That is, while FIG. 6 appears to show a more photographic corner blocking insert, FIGS. 7A-7C illustrate a more schematic depiction of the corner blocking insert rotated at various angles to show different sides thereof. FIG. 7C most closely resembles the orientation of FIG. 6. Additionally, it is appreciated that while FIG. 6 illustrates the corrugated flutes of the layers and their corresponding orientation, such flutes are not illustrated in FIGS. 7A-7C. However, it is understood that one of skill in the art could readily understand the position and orientation thereof from the illustration of FIG. 6 and the written description herein.

Turning now to FIG. 8, one example construction of the folded cardboard insert 60 will be described. Preferably, the folded cardboard insert 60 will be constructed from a single planar composite board or sheet 90 from which both of the first insert 70 and the second insert 80 are cut out. That is, as shown, the single planar sheet 90 can be a unitary, continuous sheet that has selected portions cut out and discarded to provide the specific shape of each of the first and second inserts 70, 80. Preferably, the shape and size of the first and second inserts 70, 80 are identical, although reversed for efficient space usage of the single planar sheet. Further, in the example shown in FIG. 8, the single planar sheet 90 is of a size capable of provide a similar or identical second cardboard insert 60B with first and second inserts 70B, 80B. Depending on the size and geometry of the single planar sheet 90, various numbers of sheets for folded cardboard inserts can be obtained. For brevity, only construction of one folded cardboard insert 60 will be described.

Each of the first and second inserts 70, 80 are a continuous, unitary element that will be folded together to obtain the final folded cardboard insert 60. That is, the three layers 71, 73, 75 of the first insert 70 are interconnected to each other along two fold points, a primary fold point 72 along one of the long edges 64, 66, and a secondary fold point 74 along one of the short edges along the curved edge 62. Preferably, the primary fold point 72 is positioned to correspond to the center of one of the long edges 64, 66 of the folded cardboard insert 60, and the secondary fold point 74 is positioned to correspond to the center or vertex of the curved edge 62 of the folded cardboard insert 60.

When the first insert 70 is cut out of the planar sheet 90, a spacing gap 76 is defined between the layers 71, 73. The spacing gap 76 has a width that is generally similar to a thickness of the alternate layer 81 that will be interposed the layers 71, 73. The cut out spacing gap 76 does not include a flap 77 that is defined by the primary fold point 72. Instead, the primary fold point 72 is defined by the flap 77 that interconnects layer 71 and layer 73. Optionally, one or more side edges of the flap 77 can include slits at the respective connection to the layers 71, 73 to facilitate the folding over of the primer fold point 72. In order to make the folded cardboard insert 60 compact, and further strengthen the connection between the first and second inserts 70, 80, another long side of layer 75 (i.e., the layer that is interconnected by the secondary fold point 74) may include a cut out 79 that corresponds generally to the shape and location of the flap 87 of the opposite layer, as will be described.

Similarly, the second insert 80 also includes substantially identical layers 81, 83, 85, with a primary fold point 82 and secondary fold point 84, as well as spacing gap 86, flap 87, and cut-out 89.

Once the first and second inserts 70, 80 are cut out, they can then be folded and interleaved together to form the folded cardboard insert 60. It is to be appreciated that to obtain the configuration wherein the first corrugated flutes 76*a*-76*c* of the first insert 70 (longitudinal direction F1) are arranged perpendicular to the second corrugated flutes 86*a*-86*c* of the second insert 80 (longitudinal direction F2), the first and second inserts 70, 80 are arranged and folded opposite to each other.

To create the folded cardboard insert 60, the layer 71 is folded over to be co-facial over layer 73 at the primary fold point 72. Due to the spacing gap 76, a space or void is created between layers 71 and 73. layer 81 of second insert 80 is then inserted into this gap or void between layers 71, 73 and is oriented so that the longitudinal flutes of layer 81 are arranged perpendicular to the longitudinal flutes of both of layers 71, 73. Additionally, the flap 77 defining the primary fold point 72 is disposed within the corresponding cut-out 89 of layer 81.

Next, layer 81 is folded over the secondary fold point 84 so that layer 83 is disposed underneath and co-facial with layer 73. Again, the longitudinal direction of the flutes of layer 83 is oriented perpendicular to the flutes of layers 71, 73. Next layer 83 is folded over the primary fold point 82 so that there is a spacing gap between layers 83, 85. Lastly layers 73, 75 are folded over the secondary fold point 74 and layer 75 is interposed between layers 83, 85. Again the flap 87 of the primary fold point 82 is inserted into the cut-out 79 of layers 75. Preferably, the cut-outs 79, 89 are generally equal in width, or even slightly smaller, than the width of the corresponding flaps 77, 87 so that friction can help to hold the flaps 77, 87 in place.

Construction of the folded cardboard insert 60 is now complete. Due to this opposite and alternating folded construction, all of the corrugated flutes 76*a*-76*c* of layers 71, 73, 75 are oriented perpendicular to the corrugated flutes 86*a*-86*c* of layers 81, 83, 85. Additionally, insertion of the flaps 77, 87 into the corresponding cut-outs 79, 89 further help to maintain attachment of the first insert 72 to the second insert 80. Optionally, adhesives and/or glues may be used between any of the various layers of layers 71, 73, 75, 81, 83, 85, and/or various tapes may be used externally to maintain the assembled unitary body construction and shape of the folded cardboard insert 60.

Optionally, it is possible for further cutouts in the various layers of layers 71, 73, 75, 81, 83, 85 of either or both of the first and second inserts 70, 80 to create a hollow interior within the interior of the completed folded cardboard insert 60 to provide spacing for an impact "crush zone." Thus, if the container 10 is accidentally dropped, the resulting force impact that may occur on a corner 19 of the container 10 may be at least partially absorbed by a deformation of the impact "crush zone", without allowing the rim of the wire spool to lance through or puncture the shipping box.

Figure 10:
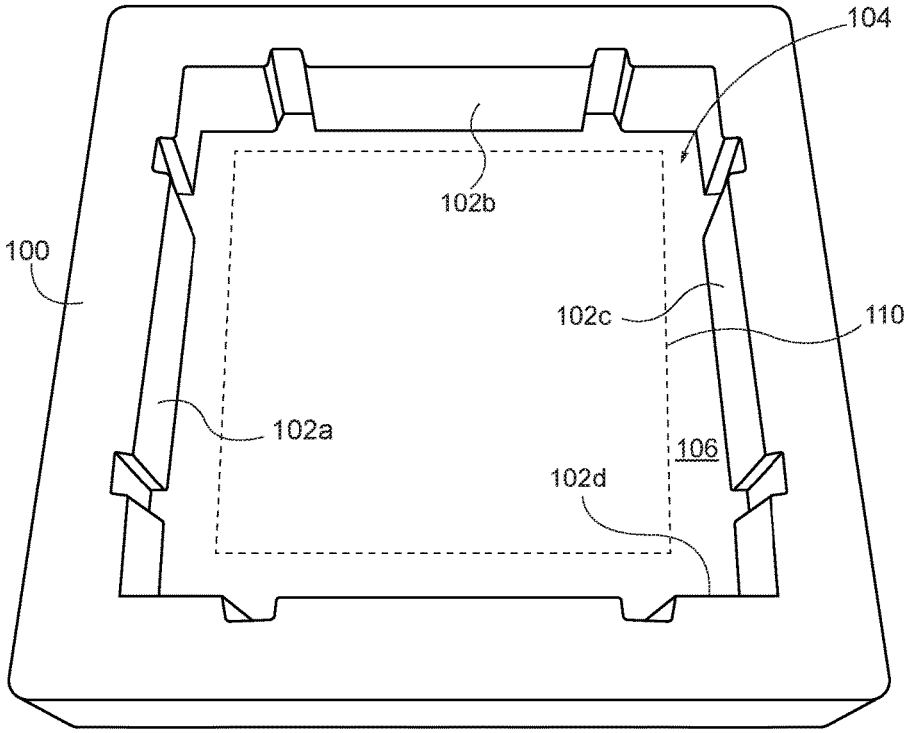
FIG. 10 illustrates an example cradle of an overwrap assembly.
Figure 11:
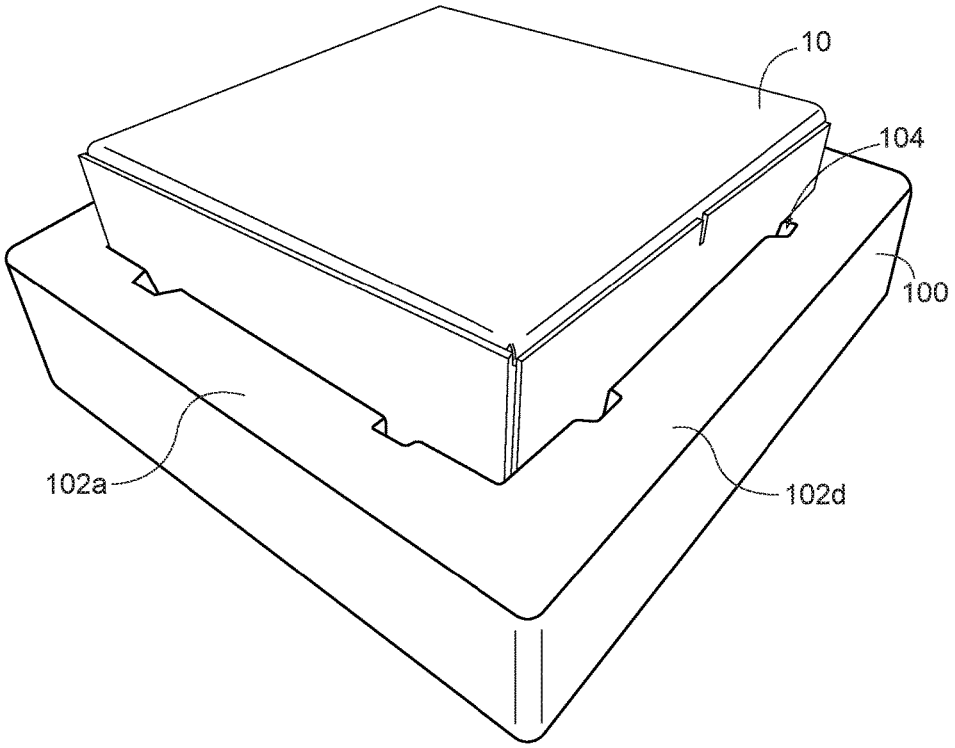
FIG. 11 illustrates an example manner of packaging the container for shipment within the overwrap assembly.

Turning out to FIGS. 10-11, final packaging of the container 10 for shipment will be described. The spool 12 of welding wire to be shipped to a customer is placed within the container 10, and then the corner blocking insert(s) 50 are inserted into the corner voids 49 of the container 10 as previously described herein. The container 10 is then placed in an overwrap assembly. As shown in FIG. 10, the overwrap assembly may comprise a two-piece crate comprising a pair of malleable cradles 100 that are positioned external to each side of the container 10. In one example, and malleable cradle comprises a rigid, but malleable foam material contained preferably within a plastic outer wrap (e.g., a shrink-wrapped rigid foam).

The malleable cradle 100 preferably has a shape complementary to the exterior shape of the container 10, and provides shock absorbency in along all faces of the container 10. The malleable cradle 100 comprises an outer ring 102A-102D that extends along all four vertical side walls 18, 20, 22, 24 of the container 10. The interior wall surfaces of the outer ring 102A-102D may optionally include slots or recesses to facilitate insertion and extraction of the container 10 into/from the malleable cradle 100. The malleable cradle 100 further comprises a central recess 104 sized to accept the container 10 in a snug, form-fitting fashion. The central recess 104 is defined by and bounded by the outer ring 102A-102D. The planar bottom surface 106 of the central recess 104 is configured to support and extend along face 14 or 16 of the container 10. Additionally, surface 106 further comprises a rigid backing plate 110 that extends across a majority of surface 106. The rigid backing plate 110 can be substantially more rigid relative to the malleable material of the malleable cradle 100. In one example, the backing plate 110 comprises a wood sheet, such as OSB, plywood, or chipboard. When the malleable cradle 100 is constructed, the rigid backing plate 110 is placed within the recess 104 before the foam material of the shell is encapsulated by the outer plastic wrap, thereby securely affixing the backing plate 110 to the bottom surface 106.

The purpose of the rigid backing plate 110 is to effectively transfer the forces that occur during a corner edge drop of the container 10 into a radial load so that said forces are successfully directed to and absorbed by the corners of the malleable cradle 100. That is, the impact force experienced during a corner edge drop of the container 10 is translated linearly across the backing plate 110 and is thereby directed specifically into one or more of the corner blocking inserts 50. The rigid backing plate 110 may also directly protect faces 14, 16 of the container 10. Moreover, during flat face drops, the rigid backing plate 110 also protects the flange portions of the wire spool from deformation or breakage due to the coil of wire tending to punch through the flange portions. The rigid backing plate 110 is interposed between the resiliency of the cradle and the face of the shipping carton (and by extension the flange portions of the wire spool), to prevent the core of wire from moving relative to the flange portions of the spool and deforming or breaking the flange portions.

Turning now to FIG. 11, in preparation for shipping the container 10 is inserted into the recess 104 of the malleable cradle 100. Preferably, a height of the outer ring 102A-102D is approximately half the total height of the container 10 between the apex 21 of the vertical side walls 18, 20, 22, 24. Thereafter a second and substantially identical malleable cradle 100 is placed on top of the container 10, whereby the container 10 is now completely encapsulated by the two malleable cradles 100. This effectively creates the two-piece crate where the container 10 is held in the center of a pair of rigid foam packing protectors (one on top, one on bottom) that completely encapsulate the container 10. It is appreciated that in FIG. 11, only malleable cradle 100 is shown for clarity. Lastly, the combined assembly of the two malleable cradles 100 with the container 10 is then placed within an outer cardboard box (not shown), which is sealed and finally shipped to a customer. It is appreciated that the fully packaged assembly may be shipped directly and/or placed on a pallet with other similar boxes for bulk shipment.

Preferably, the container 10 is formed from corrugated cardboard material and the corner blocking inserts 50 are formed, as discussed herein either from expanding foam or from arranged corrugated cardboard material (or even a strengthened paperboard material). After the container is used, some or preferably all parts of the box can be recycled. Still, other materials are contemplated.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A container for packaging a spool, said container comprising:

a box comprising opposed first and second face panels that are separated by four vertical side walls and four vertically extending corners, each corner defining a corner void within an interior of the box;

at least one aperture on the four vertical side walls, located adjacent to one of the four vertically extending corners and being defined by a frangible connection on one of the four vertical side walls so that the interior of the box is initially inaccessible; and at least one corner blocking insert comprising an outer profile that corresponds to the spool located within said box, wherein, after said frangible connection of the at least one aperture is breached, the at least one corner blocking insert is inserted into the interior of the box via said at least one aperture at one of the four vertical side walls, and wherein the at least one corner blocking insert is engageable with at least one of an outer perimeter rim of said spool, or an outer perimeter of a coil wound on the spool, located within said box, wherein the corner blocking insert that is inserted into the interior of the box through the at least one aperture is arranged to abut against an interior surface of two adjacent vertical side walls located at said one vertically extending corner, and wherein the container further comprises an overwrap assembly that includes first and second malleable cradles positioned external to the first and second face panels of the box, the malleable cradles each comprising an outer ring that defines and bounds a central recess that receives the box therein, wherein the central recess comprises a planar bottom surface configured to support and extend along one of the face panels of the box, and the planar bottom surface further comprises a rigid backing plate that extends across a majority of the planar bottom surface, the rigid backing plate being formed of a material that is substantially more rigid relative to a malleable material of the malleable cradles.

2. The container of claim 1, wherein the corner blocking insert comprises an expanding foam package that is initially malleable when inserted into the box, and cures thereafter to a rigid foam monolithic body.

3. The container of claim 2, wherein the foam package comprises an expanding foam material contained within a sealed malleable bag that enables the expanding foam to conform to the interior of the box and geometry of the spool, with the malleable bag acting as a barrier between the expanding foam material and the coil wound on the spool.

4. The container of claim 3, wherein the foam package is sized, when fully expanded to the rigid foam monolithic body, to substantially completely occupy said corner void within the interior of the box.

5. The container of claim 1, wherein the corner blocking insert comprises a folded cardboard insert that comprises a combination of a first insert interleaved with a second insert.

6. The container of claim 5, wherein each of the first and second inserts comprise corrugated cardboard flutes, and wherein the first and second inserts are interleaved together so that their respective cardboard flutes are oriented in two perpendicular planes.

7. The container of claim 6, wherein the folded cardboard insert comprises two edges that are configured to abut, respectively, two adjacent interior vertical side walls of the box, and wherein the corrugated cardboard flutes of the first insert are positioned normal to one of said two interior vertical side walls of the box, and the corrugated cardboard flutes of the second insert are positioned normal to the other of said two interior vertical side walls of the box.

8. The container of claim 7, wherein the folded cardboard insert comprises a third edge with a curved recess to at least partially receive said spool containing the coil.

9. The container of claim 5, wherein each of the first and second inserts comprise a unitary body with a plurality of layers interconnected by a primary fold point and a secondary fold point.

10. The container of claim 9, wherein the first insert is interleaved with the second insert by alternating layers of said plurality of layers of each insert.

11. The container of claim 1, wherein said box comprises a corrugated cardboard material.

12. A container for packaging a welding wire, said container comprising:

a box comprising opposed first and second face panels that are separated by four vertical side walls and four vertically extending corners, each corner defining a corner void within an interior of the box;

at least one aperture on the four vertical side walls, located adjacent to one of the four vertically extending corners and being defined by a frangible connection on one of the four vertical side walls so that the interior of the box is initially inaccessible; and at least one corner blocking insert comprising an outer profile that corresponds to a spool containing a coil of welding wire located within said box, wherein, after said frangible connection of the at least one aperture is breached, the at least one corner blocking insert is inserted into the interior of the box via said at least one aperture at one of the four vertical side walls, and wherein the at least one corner blocking insert is engageable with at least one of an outer perimeter rim of said spool containing a coil of welding wire, or an outer perimeter of the coil of welding wire, located within said box, and wherein the corner blocking insert that is inserted into the interior of the box through the at least one aperture is arranged to abut against an interior surface of two adjacent vertical side walls located at said one vertically extending corner, wherein the frangible connection of each aperture comprises at least one side with an at least partial die-cut or score line, wherein the frangible connection of each aperture comprises at least one non-frangible side that is secured to one of the face panels or vertical side walls to form a pivotable flap, wherein after said frangible connection is breached, the pivotable flap is rotated external to the box, or received within the interior of the box, to thereby expose the aperture, and, wherein each aperture has a generally rectangular geometry comprising at least one major side and one minor side.

13. The container of claim 12, wherein each corner blocking insert has a height equal to or less than a length of the minor side of the aperture, and said height is about one half a height of a vertically extending corner adjacent to the aperture.

14. The container of claim 12, wherein the corner blocking insert comprises an expanding foam package that is initially malleable when inserted into the box, and cures thereafter to a rigid foam monolithic body.

15. The container of claim 14, wherein the foam package comprises an expanding foam material contained within a sealed malleable bag that enables the expanding foam to conform to the interior of the box and geometry of the spool, with the malleable bag acting as a barrier between the expanding foam material and the coil of welding wire.

16. The container of claim 15, wherein the foam package is sized, when fully expanded to the rigid foam monolithic body, to substantially completely occupy said corner void within the interior of the box.

17. The container of claim 12, wherein the corner blocking insert comprises a folded cardboard insert that comprises a combination of a first insert interleaved with a second insert.

18. The container of claim 17, wherein each of the first and second inserts comprise corrugated cardboard flutes, and wherein the first and second inserts are interleaved together so that their respective cardboard flutes are oriented in two perpendicular planes.

19. The container of claim 17, wherein each of the first and second inserts comprise a unitary body with a plurality of layers, and the first insert is interleaved with the second insert by alternating layers of said plurality of layers of each insert.

20. A container for packaging a welding wire, said container comprising:

a box comprising opposed first and second face panels that are separated by four vertical side walls and four vertically extending corners, each corner defining a corner void within an interior of the box;

at least one aperture on the four vertical side walls, located adjacent to one of the four vertically extending corners and being defined by a frangible connection on one of the four vertical side walls so that the interior of the box is initially inaccessible; and at least one corner blocking insert comprising an expanding foam package, contained within a sealed malleable bag, that is initially malleable when inserted into the box, and cures thereafter to a rigid foam monolithic body with an outer profile that corresponds to a spool containing a coil of welding wire located within said box, wherein, after said frangible connection of the at least one aperture is breached, the at least one corner blocking insert is inserted into the interior of the box via said at least one aperture at one of the four vertical side walls, and wherein the at least one corner blocking insert is engageable with at least one of an outer perimeter rim of said spool containing a coil of welding wire, or an outer perimeter of the coil of welding wire, located within said box, wherein the corner blocking insert that is inserted into the interior of the box through the at least one aperture is arranged to abut against an interior surface of two adjacent vertical side walls located at said one vertically extending corner, and wherein the expanding foam package is sized, when fully expanded to the rigid foam monolithic body, to substantially completely occupy said corner void within the interior of the box, and wherein the container further comprises an overwrap assembly that includes first and second malleable cradles positioned external to the first and second face panels of the box, the malleable cradles each comprising an outer ring that defines and bounds a central recess that receives the box therein, wherein the central recess comprises a planar bottom surface configured to support and extend along one of the face panels of the box, and the planar bottom surface further comprises a rigid backing plate that extends across a majority of the planar bottom surface, the rigid backing plate being formed of a material that is substantially more rigid relative to a malleable material of the malleable cradles.

* * * * *